US011564549B1

(12) United States Patent
Ancheta et al.

(10) Patent No.: US 11,564,549 B1
(45) Date of Patent: Jan. 31, 2023

(54) MULTIDIRECTIONAL DUSTING TOOL

(71) Applicant: Carl Freudenberg KG, Weinheim (DE)

(72) Inventors: Robert Ancheta, Aurora, IL (US); Doug Metzel, Lombard, IL (US); Eric Martin, St. Charles, IL (US); Robert G. Challman, Naperville, IL (US)

(73) Assignee: Carl Freudenberg KG, Weinheim (DE)

( * ) Notice: Subject to any disclaimer, the term of this patent is extended or adjusted under 35 U.S.C. 154(b) by 0 days.

(21) Appl. No.: 17/478,700

(22) Filed: Sep. 17, 2021

(51) Int. Cl.

| | |
|---|---|
| ***A47L 13/16*** | (2006.01) |
| ***A47L 13/38*** | (2006.01) |
| ***A47L 13/42*** | (2006.01) |
| ***A47L 13/44*** | (2006.01) |

(52) U.S. Cl.
CPC ..... *A47L 13/16* (2013.01); *A47L 13/38* (2013.01); *A47L 13/42* (2013.01); *A47L 13/44* (2013.01)

(58) Field of Classification Search
CPC ..... A47L 13/16; A47L 13/24; A47L 13/38; A47L 13/42; A47L 13/44; A47L 13/46; A47L 13/252; A47L 13/253; B25G 3/02; B25G 3/10; B25G 3/12; B25G 3/14; B25G 3/28; B25G 3/38; B25G 1/02; B25G 1/06
USPC ..... 15/209.1, 210.1, 220.3, 234
See application file for complete search history.

(56) References Cited

U.S. PATENT DOCUMENTS

| | | | | |
|---|---|---|---|---|
| 8,136,196 | B2 * | 3/2012 | Dingert | A47L 13/42 15/209.1 |
| 8,438,690 | B2 * | 5/2013 | Tanaka | A47L 13/254 15/209.1 |
| 2006/0200929 | A1 * | 9/2006 | Knopow | A47L 13/38 15/210.1 |

* cited by examiner

*Primary Examiner* — Orlando E Aviles
*Assistant Examiner* — Sukwoo James Chang
(74) *Attorney, Agent, or Firm* — Leydig, Voit & Mayer, Ltd.

(57) ABSTRACT

A dusting tool having a flexible skeletal element including a base, from which four elongated arms extend. The elongated arms have a base end and a distal end. The base ends extend from the base and being spaced apart from one another at the base. The arms being flexible and resilient. A plurality of cross-members extend between the elongated arms, a plurality of living hinges being disposed between the plurality of cross-members and the elongated arms. A force applied to at least one of the elongated arms is transmitted to the other of the elongated arm by the plurality of cross-members and the plurality of living hinges.

24 Claims, 16 Drawing Sheets

MULTIDIRECTIONAL DUSTING TOOL

TECHNICAL FIELD

This patent disclosure relates generally to cleaning implements and, more particularly to dusting tools.

BACKGROUND

Various tools and have been proposed for facilitating dusting. Some dusting tools include rigid or semi-rigid bars upon which is mounted a cleaning cloth having a plurality of fiber sections. The dusting tools may be attached to a relatively short handle unit for dusting readily accessible surfaces, or a rod or pole to allow the dusting tool to reach elevated surfaces. In use, the dusting tool is moved across the surfaces to be cleaned, and the dust particles are trapped in the fiber sections.

Many of these devices, however, have limitations regarding effectiveness or ease of use. For example, the bars of this type of dusting tool generally have a rigid design, which makes it difficult or more time consuming to clean curved surfaces. This challenge may be aggravated when a lengthening rod or pole is utilized inasmuch as a rigid section of the dusting tool may be unable to conform to remote curved surfaces. Additionally, the edge areas and corners of elevated surfaces may only be reached with difficulty.

U.S. Pat. No. 8,136,196 to Dingert discloses a flexible dusting tool. The device includes two bars connected by film hinges to spacers that extend between the bars. A normal force exerted on one or other of the flat exterior surface of the bars causes the bars to arc, allowing the dusting tool to bend around objects in a plane perpendicular to the bars and film hinges.

SUMMARY

The disclosure describes, in one aspect, a dusting tool having a flexible skeletal element including a base, from which four elongated arms extend. The elongated arms have a base end and a distal end. The base ends extend from the base and being spaced apart from one another at the base. The arms being flexible and resilient. A plurality of cross-members extend between the elongated arms, a plurality of living hinges being disposed between the plurality of cross-members and the elongated arms. A force applied to at least one of the elongated arms is transmitted to the other of the elongated arm by the plurality of cross-members and the plurality of living hinges.

The disclosure describes, in another aspect, dusting tool having a unitarily molded flexible skeletal element and a handle assembly. The flexible skeletal element includes a base, from which four elongated arms extend. The base of the flexible skeletal element is coupled to the handle assembly. The elongated arms have a base end and a distal end. The base ends extend from the base and being spaced apart from one another at the base. The arms being flexible and resilient. A plurality of cross-members extend between the elongated arms, a plurality of living hinges being disposed between the plurality of cross-members and the elongated arms. A force applied to at least one of the elongated arms is transmitted to the other of the elongated arm by the plurality of cross-members and the plurality of living hinges.

BRIEF DESCRIPTION OF THE DRAWING(S)

DETAILED DESCRIPTION

Figure 1:
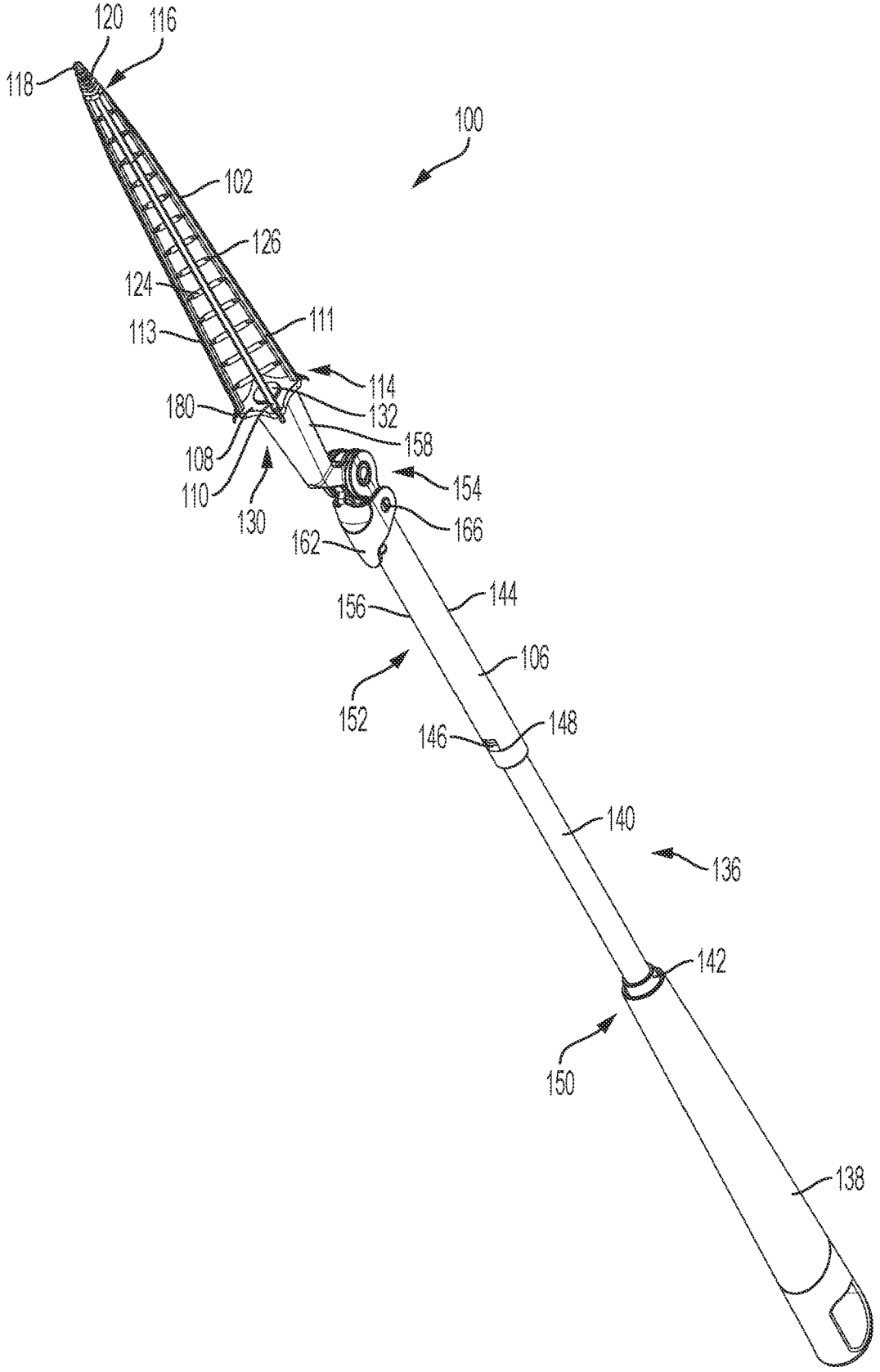
FIG. 1 is an isometric view of a dusting tool according to aspects of this disclosure.
Figure 2:
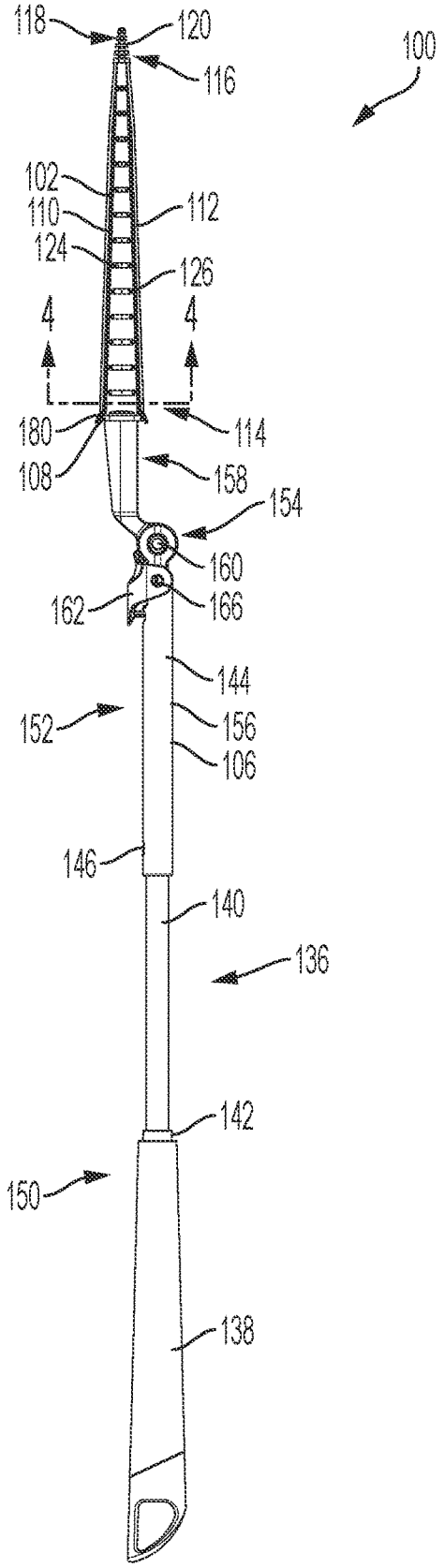
FIG. 2 is a side elevational view of the dusting tool of FIG. 1.
Figure 3:
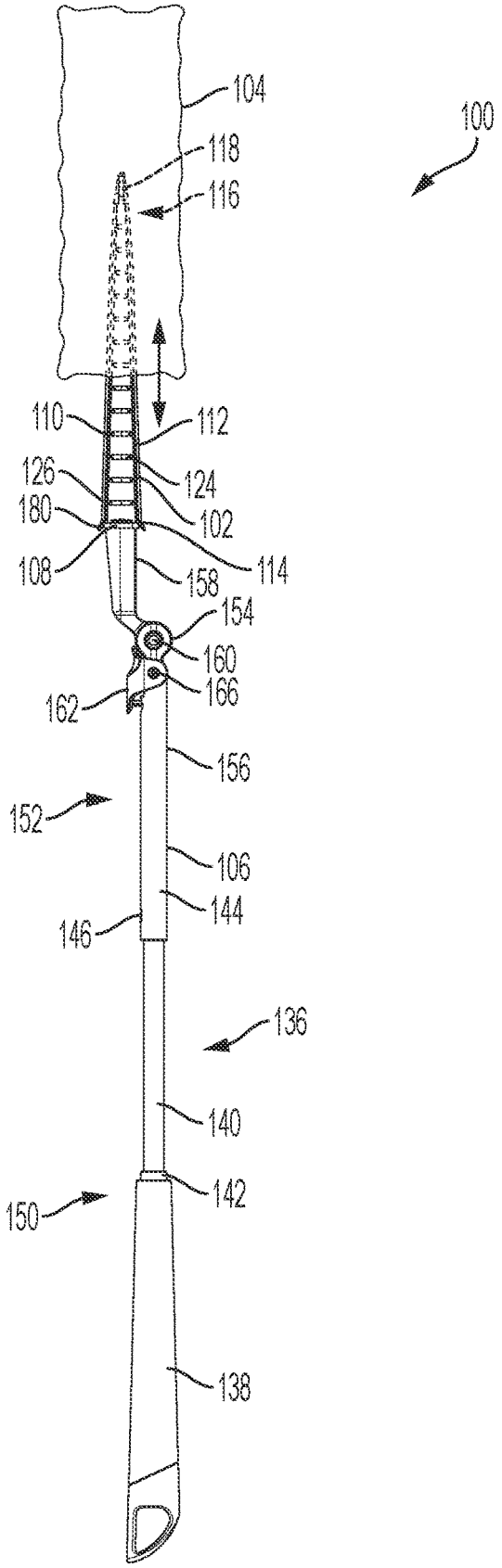
FIG. 3 is a side elevational view of the dusting tool of FIGS. 1 and 2 showing a cloth dusting element being applied to the tool.

This disclosure relates to a dusting tool 100 that may be particularly useful in dusting around objects. The dusting tool 100 includes a flexible skeletal element 102 to which a cloth dusting element 104 may be coupled for use in collecting dust (see, e.g., FIG. 3). A handle assembly 106 may be coupled to the skeletal element 102 in order to facilitate maneuvering of the skeletal element 102.

The flexible skeletal element 102 includes a base 108 from which at least three elongated arms extend, the illustrated embodiment including four elongated arms 110, 111, 112, 113. The elongated arms 110, 111, 112, 113 each have a base end 114 and a distal end 116. The base ends 114 of the elongated arms 110, 111, 112, 113 extend from the base 108 in a spaced relationship. While the elongated arms 110, 111, 112, 113 may be secured with the base 108 in substantially any configuration, in the illustrated embodiment, the elongated arms 110, 111, 112, 113 are disposed in a substantially square configuration, although the base 108 itself is not necessarily in the shape of a square.

The elongated arms 110, 111, 112, 113 are likewise coupled at their distal ends 116. While the elongated arms 110, 111, 112, 113 may be disposed in a substantially parallel relationship, for example, the elongated arms 110, 111, 112, 113 may converge toward one another. While not necessarily provided in all embodiments, the flexible skeletal element 102 may further include a distal element 118 to which the distal ends 116 of the elongated arms 110, 111, 112, 113 are connected, the distal element 118 coupling the elongated arms 110, 111, 112, 113 together at their distal ends 116. In the illustrated embodiment, the distal element 118 has a cone shape, although the distal element 118 may be of any appropriate shape. In order to assist in maintaining a cloth dusting element 104 in position on the flexible skeletal element 102, the distal element 118 may include a plurality of ribs 120.

The elongated arms 110, 111, 112, 113 are both flexible and resilient when a force is applied to the length of one or more of the elongated arms 110, 111, 112, 113. While the elongated arms 110, 111, 112, 113 may have substantially any cross-section that permits this flexible and resilient movement, in at least one embodiment, the elongated arms 110, 111, 112, 113 have a substantially round cross-section with an inwardly directed projection 122 (see FIG. 4).

Figure 7:
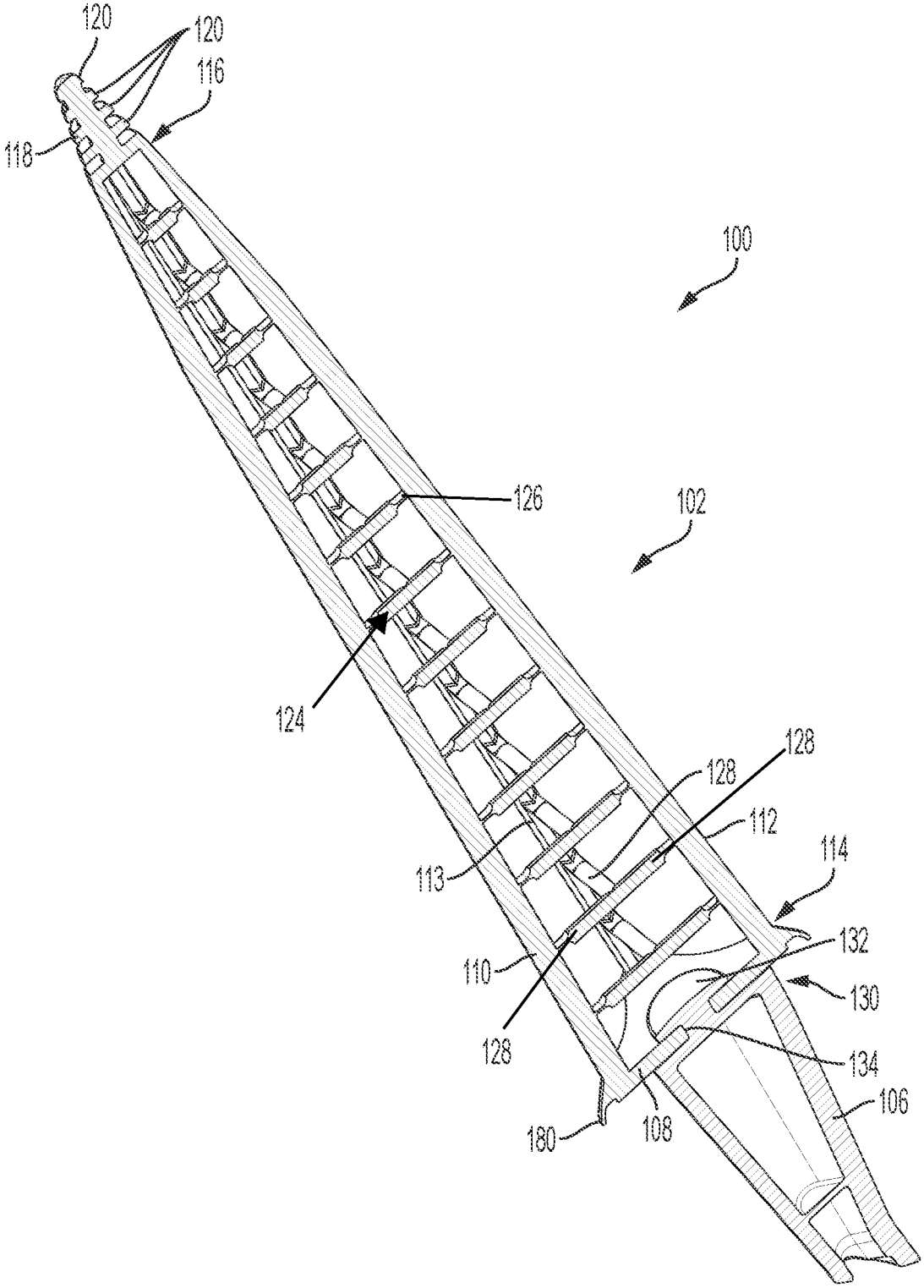
FIG. 7 is an enlarged fragmentary cross-sectional view of the dusting tool of FIGS. 1-6 taken along line 7-7 in FIG. 5.

The flexible skeletal element 102 further includes a plurality of cross-members 124 extending between the elongated arms 110, 111, 112, 113. In order to provide further flexibility of the flexible skeletal element 102, a plurality of living hinges 126 are provided disposed between the plurality of cross-members 124 and the elongated arms 110, 111, 112, 113. For the purposes of this disclosure, the term "living hinge" refers to a thinned section or an area of reduced cross-section that provides additional flexibility relative to adjacent structures, in this case, the adjacent cross-member 124 and elongated arms 110, 111, 112, 113. The living hinges 126 may best been seen in the cross-sectional view of FIG. 7.

Figure 4:
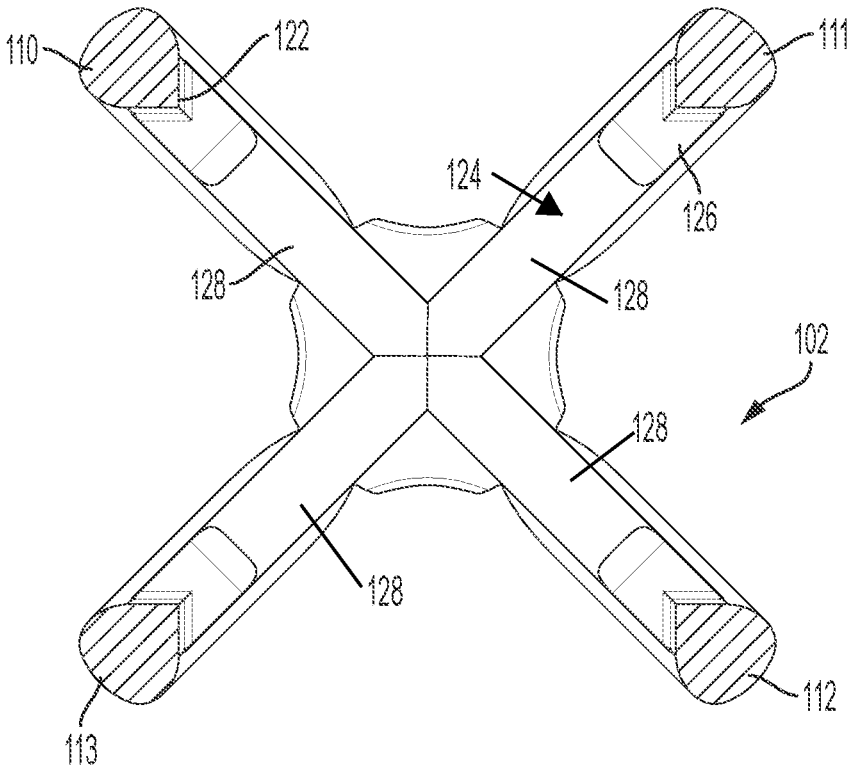
FIG. 4 is an enlarged cross-sectional view of a flexible skeletal element of the dusting tool of FIGS. 1-3 taken along line 4-4 in FIG. 2.

The cross-members 124 may present any appropriate shape between the elongated arms 110, 111, 112, 113, and may be of the same or different shapes. In order to minimize interference of the cross-members 124 with bending of the elongated arms 110, 111, 112, 113, the cross-members have a substantially planar structure. While one or more the cross-members 124 may have a square or rectangular shape, for example, the cross-members 124 may include cross-member arms 128 present a substantially planar X shape, as illustrated in FIG. 4. As may be seen in FIG. 7, for example, the cross-member arms 128 may include thinned outward ends that include the respective living hinges 126.

The flexibility of the elongated arms 110, 111, 112, 113 in conjunction with the cross-members 124 and the living hinges 126 facilitate the resilient bending or flexing of the flexible skeletal element 102 around obstacles in multiple directions in use. That is, when a force is applied to one or more of the elongated arms 110, 111, 112, 113, force is transmitted to the remaining of the elongated arms 110, 111, 112, 113 through the living hinges 126 and cross-members 124, while the base ends 114 and the distal ends 116 of the elongated arms 110, 111, 112, 113 are maintained in their respective relative positions.

Figure 8:
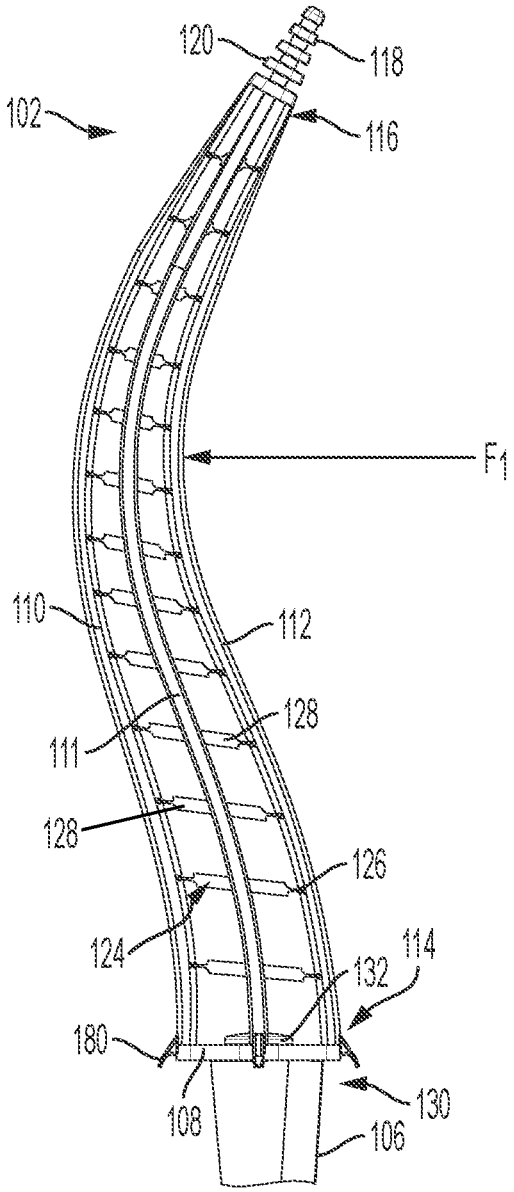
FIG. 8 is an enlarged fragmentary view of a distal end of the dusting tool of FIGS. 1-7 showing the application of a force.
Figure 9:
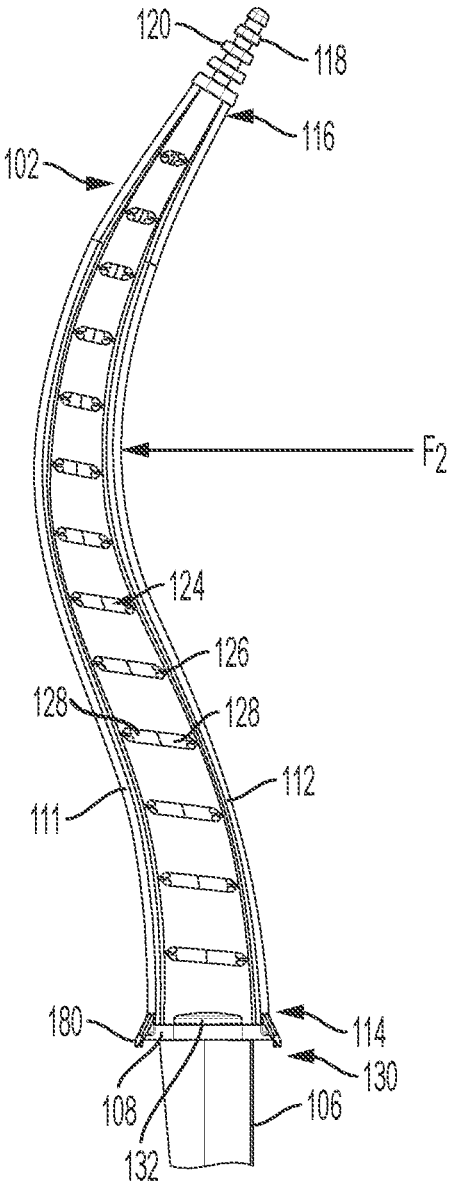
FIG. 9 is an enlarged fragmentary view of a distal end of the dusting tool of FIGS. 1-8 showing the application of a force.

The flexibility of the flexible skeletal element 102 may be explained with regard to FIGS. 8 and 9. Whether a force F is applied to a single one of the elongated arms 110, 111, 112, 113, or to a pair of the elongated arms 110, 111, 112, 113, the base 108 and distal element 118 maintain the relative positions of the base ends 114 and the distal ends 116 of the elongated arms 110, 111, 112, 113. As the force F is applied, however, the force is likewise transmitted to the other of the elongated arms 110, 111, 112, 113 by the plurality of cross-members 124. That is, the living hinges 126 flex to allow the positions of the plurality of cross-members 124 to change relative to the elongated arms 110, 111, 112, 113 while transmitting the force, ultimately adjusting the relative positions of the elongated arms 110, 111, 112, 113 along their lengths. As the force applied to the at least one of the elongated arms 110, 111, 112, 113, the living hinges 126 disposed between at least one of the cross-members 124 and said elongated arms 110, 111, 112, 113 flex. As a result, distance between at least a portion of the length of at least two of the elongated arms 110, 111, 112, 113 is reduced.

Figure 5:
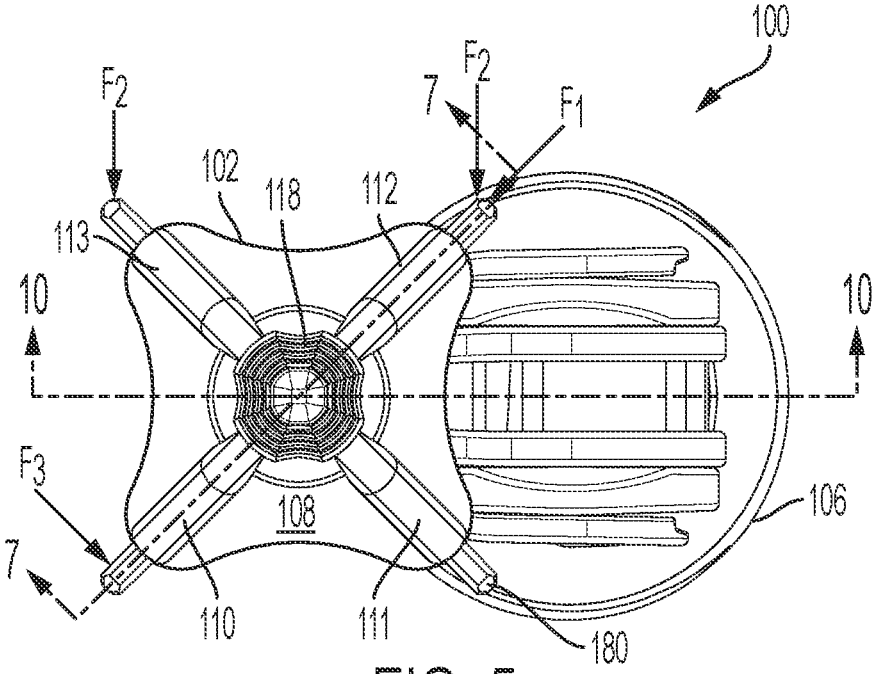
FIG. 5 is an enlarged top plan view of the dusting tool of FIGS. 1-4.
Figure 6:
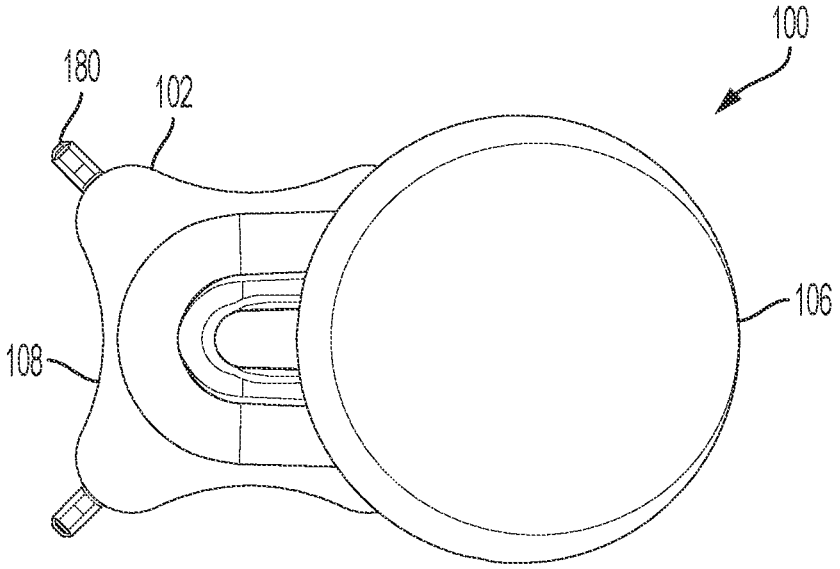
FIG. 6 is an enlarged bottom view of the dusting tool of FIGS. 1-5.

FIG. 8 illustrates a force $F_1$ being applied at a substantially normal angle to a single one 112 of the elongated arms 110, 111, 112, 113, while FIG. 9 illustrates a force $F_2$ being applied at a substantially normal angle to a pair 112, 113 of the elongated arms 110, 111, 112, 113. As may be seen in FIGS. 8 and 9, as a force F is applied to one or more of the elongated arms 110, 111, 112, 113, the living hinges 126 allow the cross-members 124 to angle relative to the elongated arms 110, 111, 112, 113, allowing at least a portion of the length of at least two of the elongated arms 110, 111, 112, 113 to move closer to one another to allow the flexible skeletal element 102 to bend in response to the applied force. It will be appreciated by those of skill in the art that a force F applied to one or more of the elongated arms 110, 111, 112, 113 at an alternate angle will likewise result in a resilient bending or flexing of the device. Depending upon the angle at which a force is applied, the bending or flexing may include a twisting of the elongated arms 110, 111, 112, 113 relative to one another. For example, a force $F_3$ applied at an alternate angle to one 110 of the elongate arms 110, 111, 112, 113 (see FIG. 5) may result in a twisting of the elongated arms 110, 111, 112, 113. Thus, the flexible skeletal element 102 provides an omnidirectional dusting tool 100 that is flexible in multiple planes. In this way, the flexible skeletal element 102 may allow a user to readily dust around structures.

Figure 16:
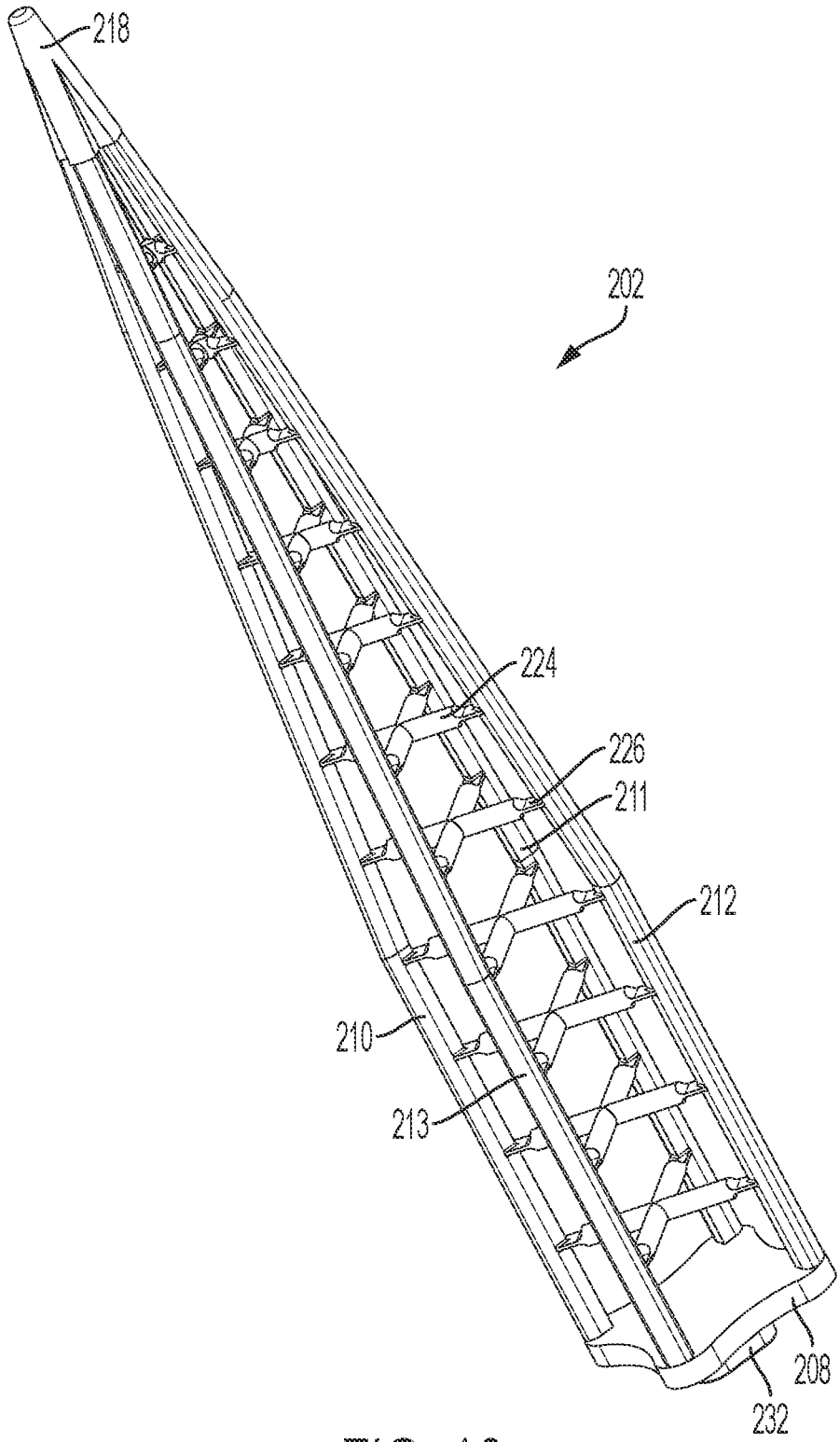
FIG. 16 is an isometric view of an alternative embodiment of a flexible skeletal element.
Figure 17:
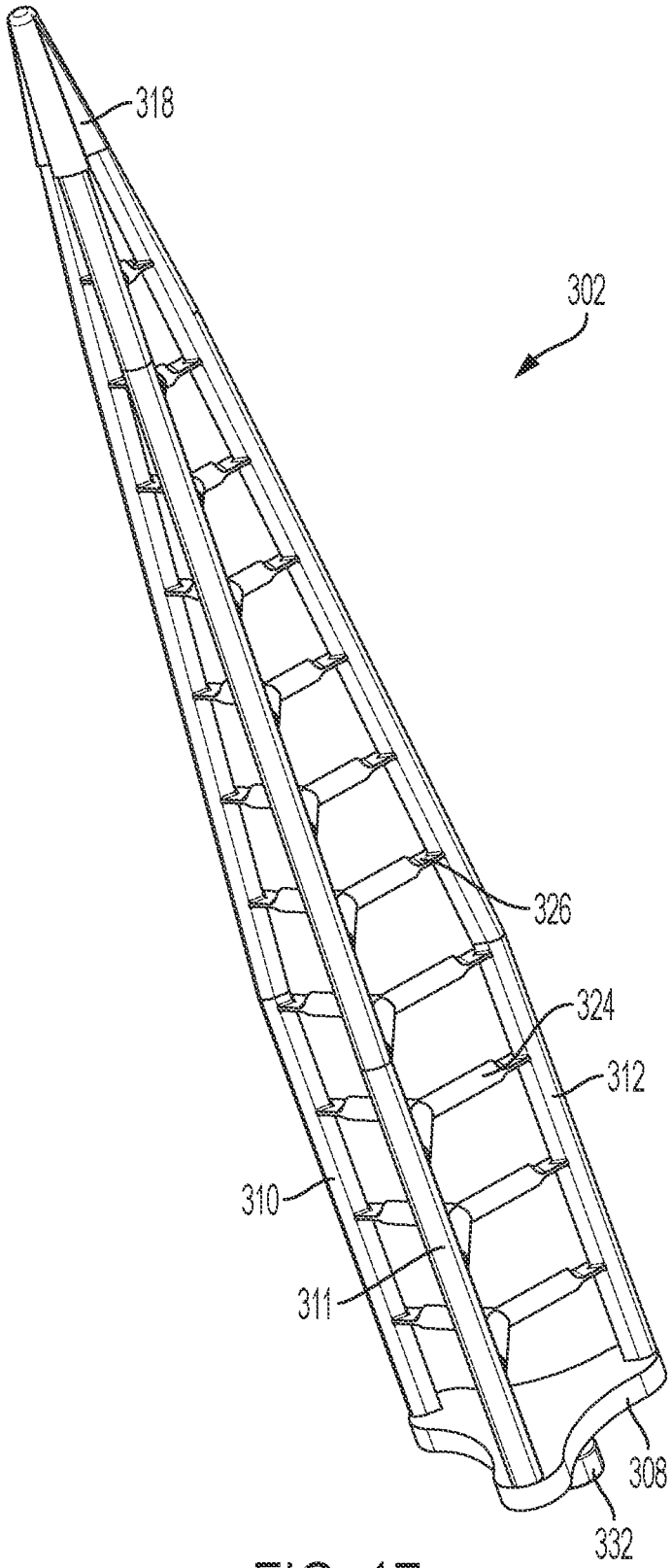
FIG. 17 is an isometric view of an alternative embodiment of a flexible skeletal element.

Alternative embodiments of the flexible skeletal element 102 are illustrated, for example, in FIGS. 16 and 17. Turning first to FIG. 16, the illustrated flexible skeletal element 202 likewise includes four elongated arms 210, 211, 212, 213 extending between a base 208 and a distal element 218. A plurality of cross-members 224 meet the elongated arms 210, 211, 212, 213 at a plurality of living hinges 226. In this embodiment, however, the elongated arms 210, 211, 212, 213 extend in a substantially parallel relationship before converging toward the distal element 218. FIG. 17 illustrates a flexible skeletal element 302 that includes three elongated arms 310, 311, 312, as opposed to four, extending between a base 308 and a distal element 318. A plurality of cross-members 324 meet the elongated arms 310, 311, 312 at a plurality of living hinges 326. As with the embodiment of FIG. 16, the elongated arms 310, 311, 312 extend in a substantially parallel relationship before converging toward the distal element 318. Those of skill in the art will appreciate, however, that elongated arms 310, 311, 312 may, for example, be substantially straight, converging toward one another from the base 308 to the distal element 318, similar to the embodiment of FIGS. 1-12. The flexible skeletal elements 202, 302 include a protrusion 232, 332 in the form of a button or the like, which can be engaged with a mating opening or the like (not illustrated) in a handle assembly.

The flexible skeletal element 102, 202, 302 may be fabricated by any appropriate method of any appropriate material that provides desired flexibility and resilience to the flexible skeletal element 102, 202, 302. For example, the flexible skeletal element 102, 202, 302 may be formed of a polymeric material such as a neoprene rubber or a thermoplastic polyurethane, and may be formed by injection molding, transfer molding, or 3-D printing. Further, the flexible skeletal element 102, 202, 302 may be unitarily formed or molded, or it may be formed with an insert, for example, in the base 108.

Returning to FIGS. 1-12, the flexible skeletal element 102 may be fixedly or rotatably coupled to the handle assembly 106 by any appropriate arrangement. While other arrangements may be utilized, in the illustrated embodiment, a distal end 130 of the handle assembly 106 includes a protrusion 132 that is received in a recess 134 in the base 108 of the flexible skeletal element 102. In an alternative embodiment, for example, the handle assembly 106 may include a recess while the base 108 includes a protrusion. In yet another embodiment, clips or fasteners may be provided to couple the flexible skeletal element 102 to the handle assembly 106, and/or the flexible skeletal element 102 and the handle assembly 106 may coupled together by an adhesive.

The handle assembly 106 may include an elongated portion 136 having a grip element 138. The grip element 138 may include a textured surface, for example, or a pliable covering for enhanced user comfort in handling of the dusting tool 100.

While the handle assembly 106 may be any appropriate design, and may be a fixed length or include structure allowing the handle assembly 106 to be effectively shortened. For example, the elongated portion 136 of the handle assembly 106 may include a telescoping structure. As will be understood by those of skill in the art in viewing FIG. 10, rod section 140 may be telescoped into and out of rod section 142, rod section 142 supporting the grip element 138.

By way of further example, the elongated portion 136 of the handle assembly 106 may include structure allowing it to be disassembled. As likewise illustrated in FIG. 10, rod section 144 may be disassembled from rod section 140. While any appropriate arrangement may be provided to allow disassembly, in the illustrated embodiment, rod section 140 is provided with a depressible button 146 that is received in an opening 148 in rod section 144. Depression of the button 146 allows the button 146 to disengage from the opening 148 in rod section 144, allowing the rod sections 140, 144 to be separated from one another. In this way, the handle assembly 106 includes a proximal subassembly 150 including rod sections 140, 142, and a distal subassembly 152 including the rod section 144.

Figure 10:
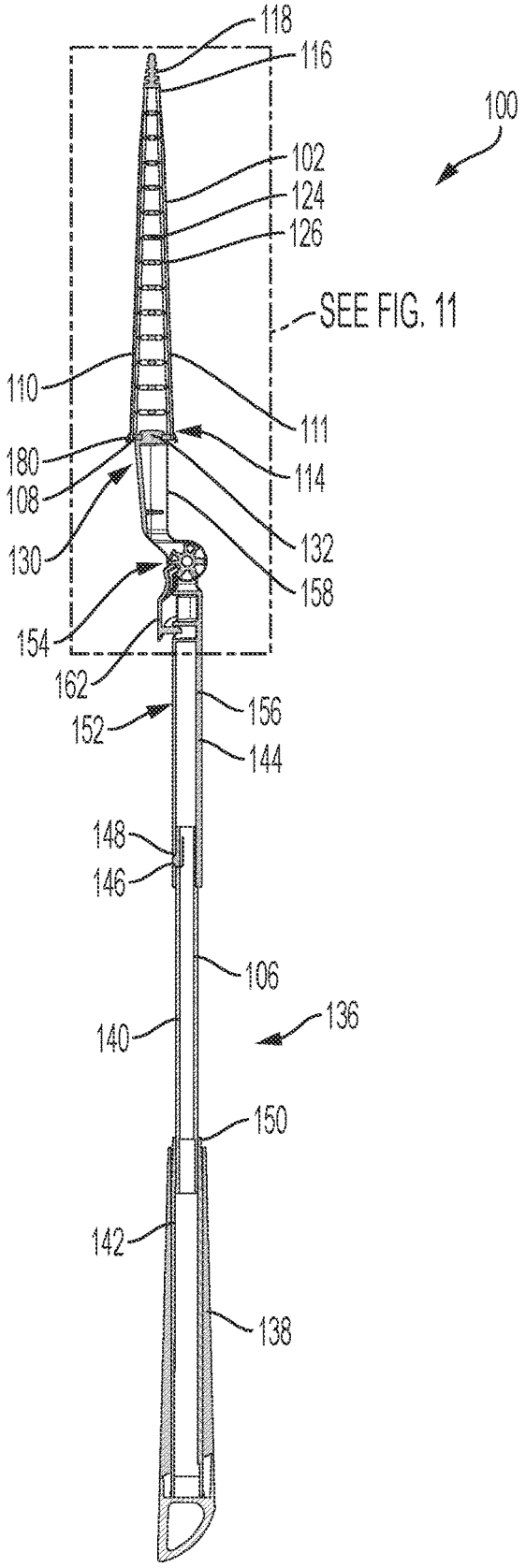
FIG. 10 is a cross-sectional view of the dusting tool of FIGS. 1-9 taken along line 10-10 in FIG. 5.
Figure 11:
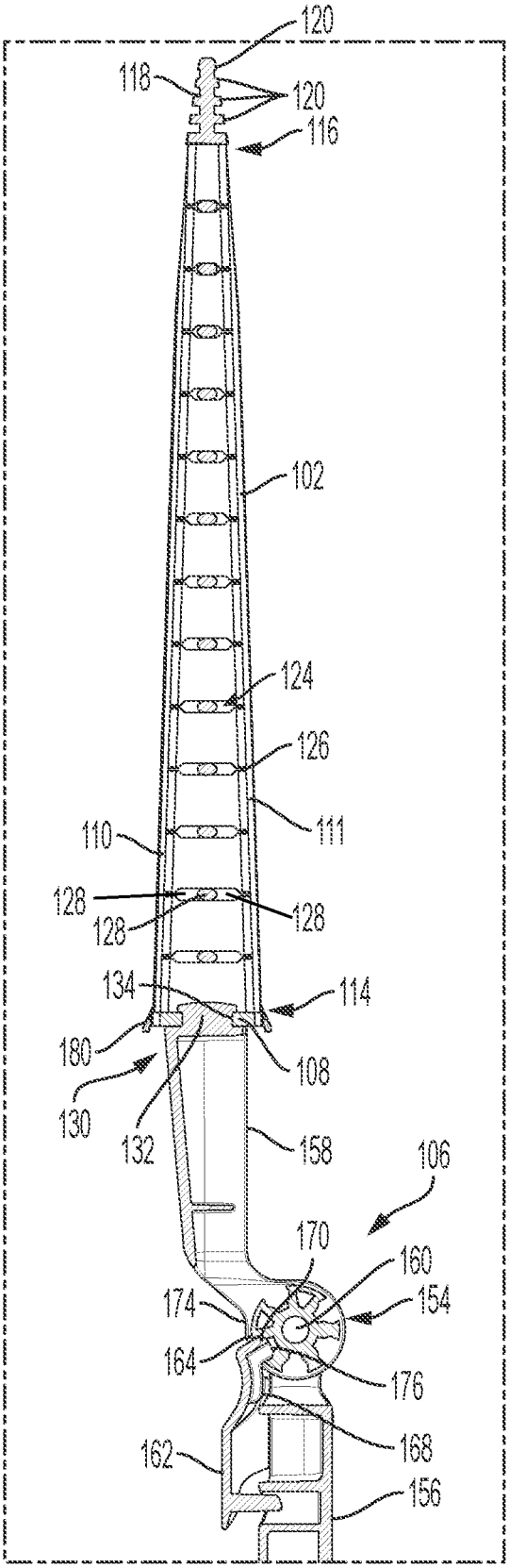
FIG. 11 is an enlarged fragmentary view of the dusting tool as illustrated in FIG. 10.
Figure 12:
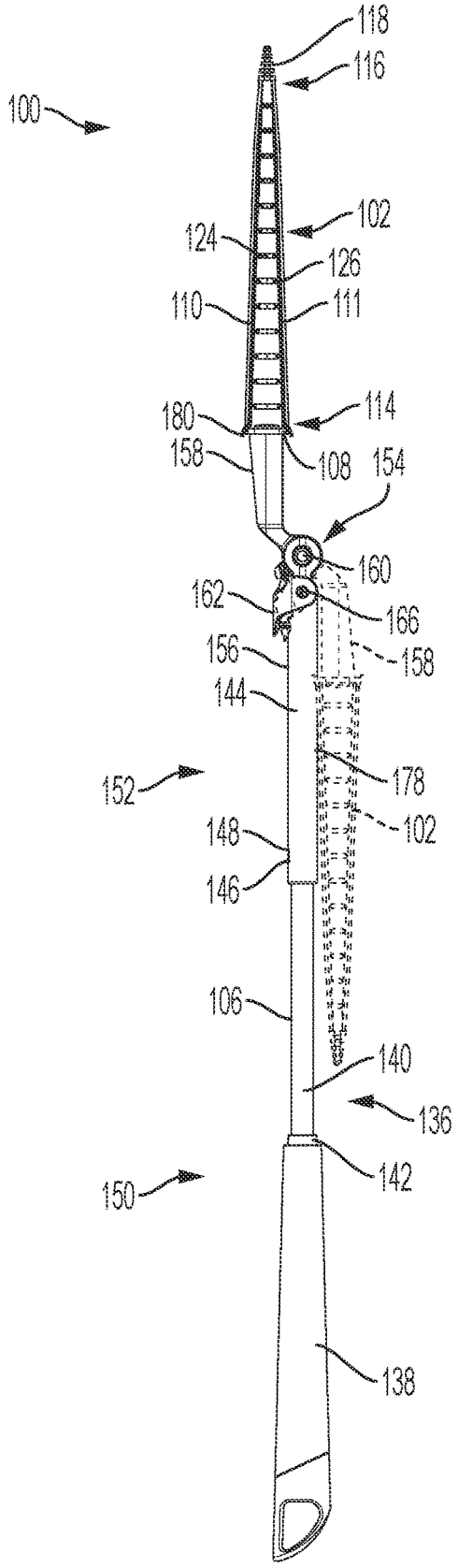
FIG. 12 is a side elevational view of the dusting tool of FIGS. 1-11 showing an alternative position in phantom.

By way of still further example, the handle assembly 106 may further include a selectively pivotable joint 154 pivotably coupling a first adjacent member 156 and a second adjacent member 158 for relative rotation about axis 160, as illustrated in FIGS. 10-12. While any appropriate mechanism to actuate and maintain the relative positions of the first and second adjacent members 156, 158 may be utilized, in the illustrated embodiment, the selectively pivotable joint 154 includes an actuator, here, an actuable lever 162 coupled to the first adjacent member 156, and at least one locking element 164 coupled to the second adjacent member 158. The actuable lever 162 is pivotably coupled to the first adjacent member 156 at axis 166. As may be seen in FIG. 11, a spring element 168 biases an engaging finger 170 of the actuable lever 162 into an engaged position with the at least one locking element 164 in order to maintain the first and second adjacent members 156, 158 in preset relative positions.

The at least one locking element 164 may include one or more detents 172 disposed to receive the engaging finger 170 of the actuable lever 162. In the illustrated embodiment, the detent 172 of the second adjacent member 158 is in the form of an opening 174 for receiving the engaging finger 170. In order to further secure the relative positions of the first and second adjacent members 156, 158, the first adjacent member 160 additionally includes a recess 176. In this way, when the engaging finger 170 of the actuable lever 162 is biased toward the detent 172, the engaging finger 170 extends through the opening 174 of the second adjacent member 158 and into the recess 176 of the first engaging member 156 when the first and second adjacent members 156, 158 are in the extended position. Conversely, when the actuable lever 162 is moved against the bias of spring element 168, the second adjacent member 158 may be pivoted down toward the first adjacent member 156, the engaging finger riding along an outside surface 178 of the second adjacent member 158 to pivot the second adjacent member 158 to the position shown in phantom in FIG. 12.

In at least one embodiment, in order to assist in maintaining the cloth dusting element 104 in position on the dusting tool 100, at least one of the base 108 of the flexible skeletal element 102 and the handle assembly 106 further includes a plurality of outwardly extending projections 180. The projections 180 are adapted to engage the cloth dusting element 104. In some embodiments, the projections 180 may engage mating openings or recesses in the cloth dusting element 104, while in some embodiments, the projections may present friction elements for inhibiting movement of the cloth dusting element 104. It will be appreciated that, while this particular embodiment includes a plurality of outwardly extending projections 180, other embodiments may include a greater or lesser number.

Figure 13:
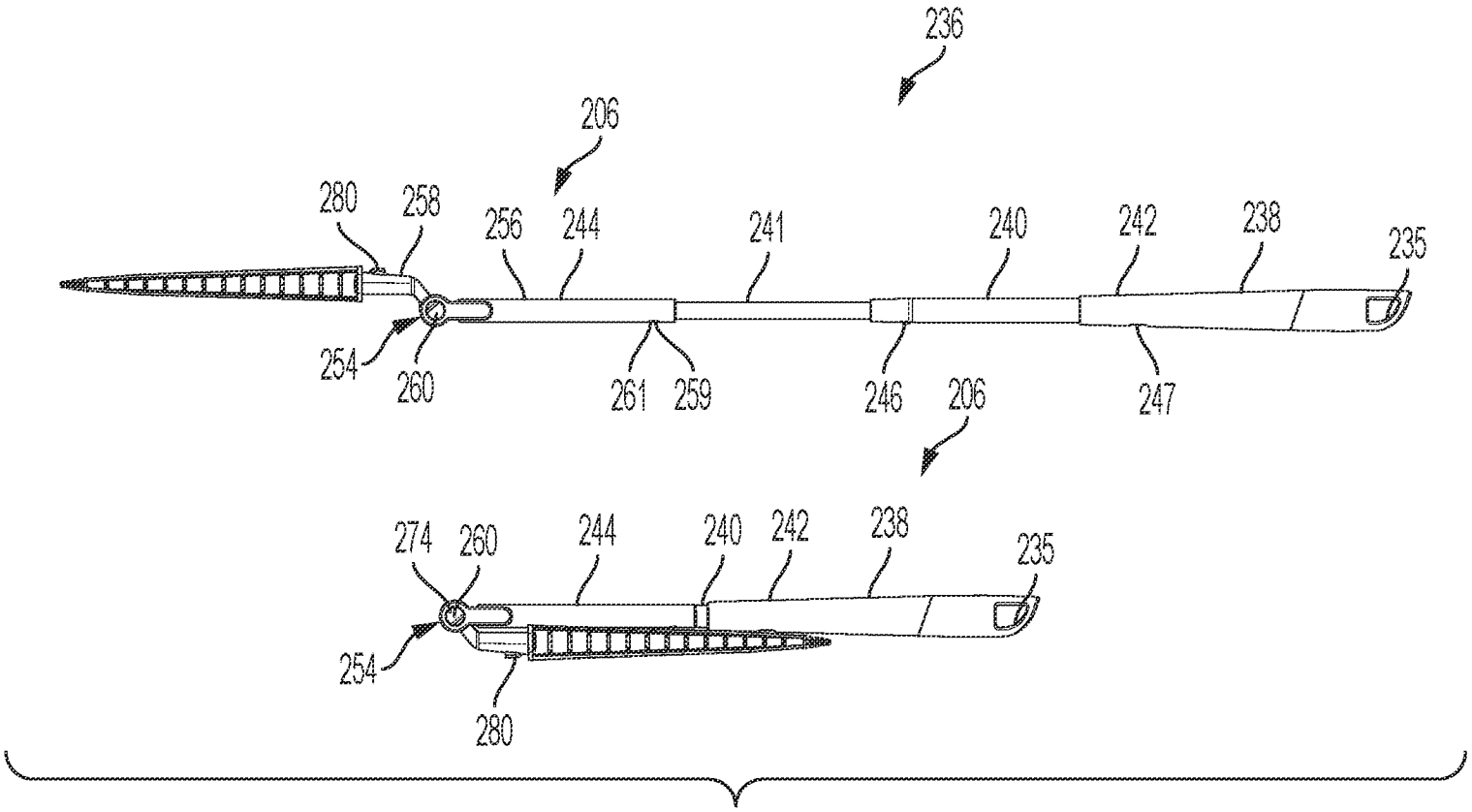
FIG. 13 is a side elevational view of an alternative embodiment of a dusting tool according to teaching of this disclosure in stored and extended positions.
Figure 14:
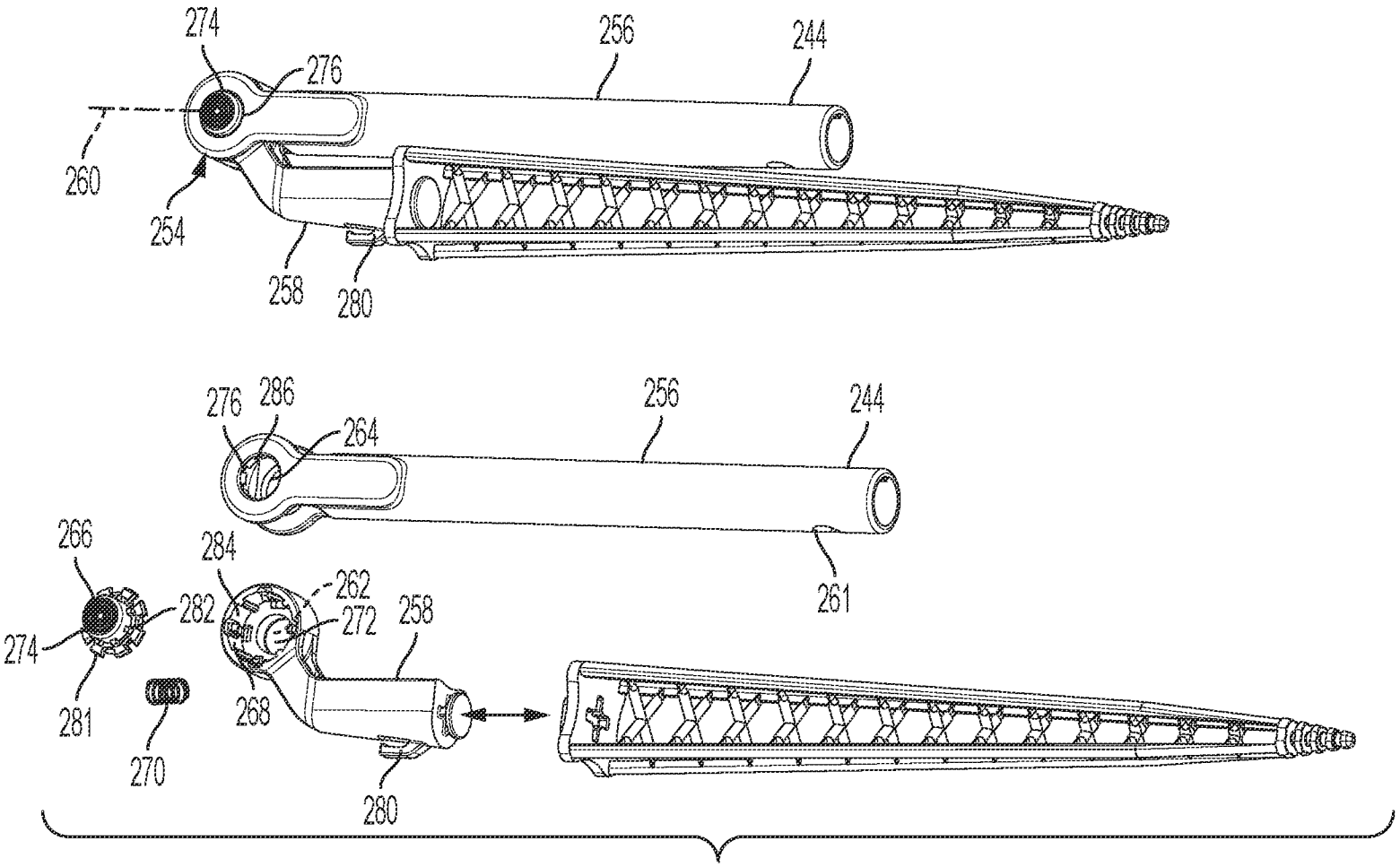
FIG. 14 shows enlarged fragmentary isometric views of the dusting tool as illustrate in FIG. 13 in assembled and exploded positions.
Figure 15:
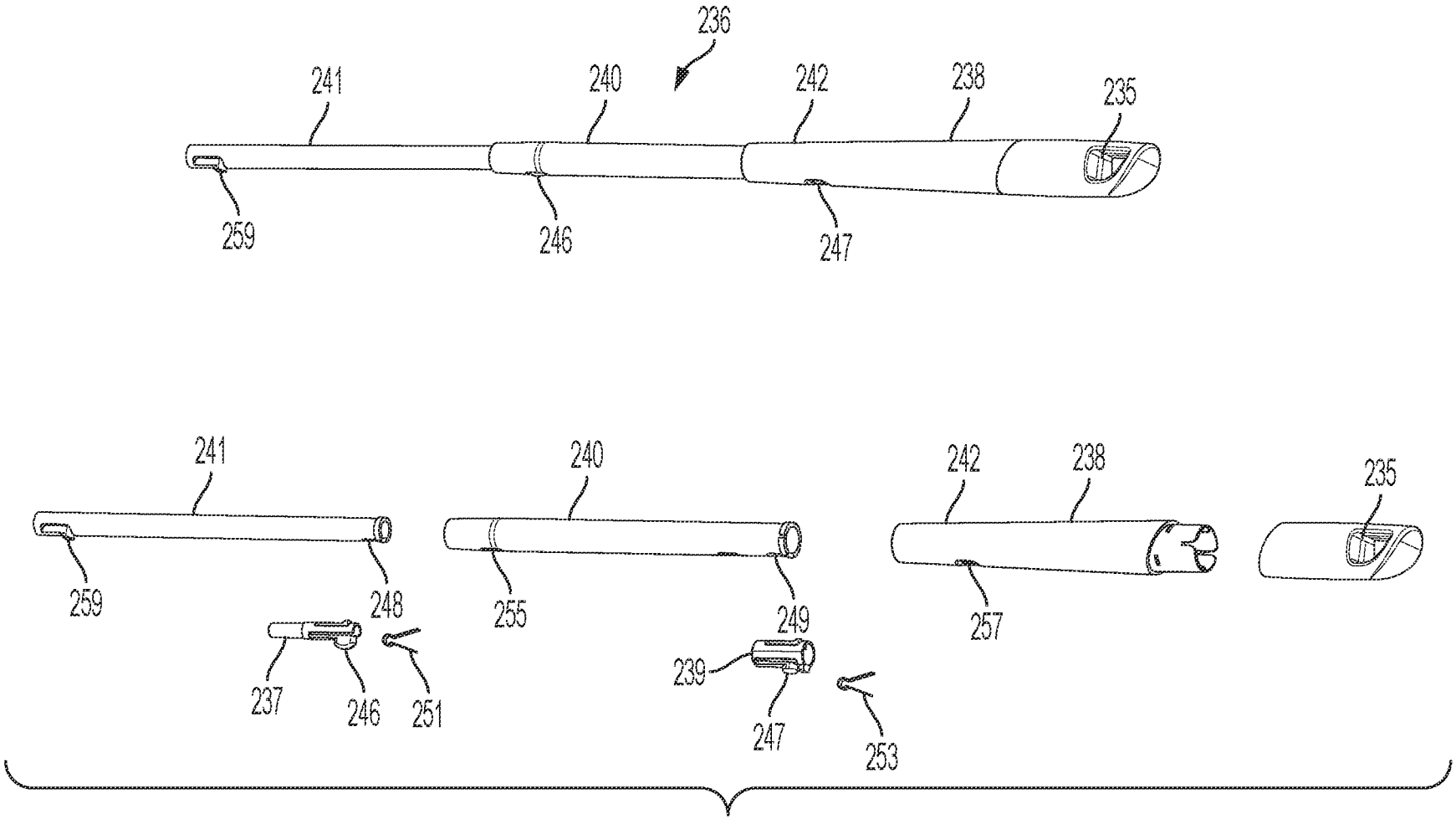
FIG. 15 shows isometric views of the handle assembly as illustrated in FIG. 13 in assembled and exploded positions.

For example, the alternative embodiment of a dusting tool 200 including handle assembly 206 illustrated in FIGS. 13-15 includes a single such outwardly extending projection 280 extending from the handle assembly 206, as opposed to the flexible skeletal element. The handle assembly 206 of FIGS. 13-15 may include an elongated portion 236 having a grip element 238, which may include a textured surface. The handle assembly 206 may further include a recess 235 to allow the dusting tool 200 to conveniently be hung on a hook or the like (not illustrated), or to receive a looped structure (not illustrated) to allow the looped structure to hang the dusting tool 200 on a hook.

The handle assembly 206 includes a telescoping structure, which allows the handle assembly 206 to be effectively shortened from the extended position illustrated in FIG. 13 to the shortened positon illustrated in FIG. 13 for sale or storage. As will be understood by those of skill in the art in viewing FIGS. 13 and 15, in particular, rod section 241 may be telescoped into and out of rod section 240, which may be telescoped into and out of rod section 242, rod section 242 supporting the grip element 238.

In the illustrated embodiment, inserts 237, 239 are disposed within and coupled to the proximal ends of rod sections 241, 240, respectively. The inserts 237, 239 include depressible buttons 246, 247, respectively, which are biased to outward positions through openings 248, 249 of the proximal ends of rod sections 241, 240 by spring elements 251, 253, respectively. In order to facilitate locking and unlocking of the rod sections 241, 240, and 242 together, the depressible buttons 246, 247 further are movably received through openings 255, 257 in the distal ends of rod sections 240, 242, respectively, when the elongated portion 236 of the handle assembly 206 is assembled and disposed in the extended position. In this way, a user may depress the button 246 to allow rod sections 241, 240 to telescopingly slide relative to one another, and depress button 247 to allow rod sections 240, 242 to telescopingly slide relative to one another. In this way, the elongated portion 236 may be shortened to approximately one-third of its length, as shown in FIG. 13.

In the embodiment of FIGS. 13-15, rod section 244 is coupled with rod section 241. As with the first embodiment, rod section 241 may include a depressible button 259 that is received in an opening 261 in rod section 244. Depression of the button 259 allows the button 259 to disengage from the opening 261 in rod section 244, allowing the rod sections 241, 244 to be separated from one another. In this way, the handle assembly 206 includes a proximal subassembly 250 including rod sections 241, 240, 242, and a distal subassembly 252 including the rod section 244.

In the embodiment of FIGS. 13-15, the proximal and distal subassemblies 250, 252 may be maintained in a coupled fashion, conveniently folded to the retracted position illustrated in FIGS. 13 and 14. That is, the handle assembly 206 may further include a selectively pivotable joint 254 pivotably coupling a first adjacent member 256 and a second adjacent member 258 for relative rotation about axis 260, as illustrated in FIGS. 13-14. In this embodiment, the first adjacent member 256 is coincident with the rod section 244.

The second adjacent member 258 includes a protrusion 262 that is disposed along axis 260 within a first recess or opening 264 in the first adjacent member 256, likewise disposed along the axis 260 to pivotably couple the first and second adjacent members 256, 258 (see FIG. 14). The selectively pivotable joint 254 further includes a locking element 266 that is disposed within a recess 268 of the second adjacent member 258, and biased outward along axis 260 by a spring element 270 seated between the locking element 266 and a recess 272 within protrusion 262.

The locking element 266 includes an actuator in the form of a depressible button 274 that is disposed through a second opening 276 in the first adjacent member 256, likewise disposed along the axis 260. In this way, the depressible button 274 and the protrusion 262 of the locking element 266 of the second adjacent member 258 are disposed along the axis 260 extending through or into the first and second openings 264, 276 of the first adjacent member 256 to pivotably couple the first and second adjacent members 256, 258.

The locking element 266 is in the form of a gear-like structure that includes first and second sets of protrusions or teeth 281, 282. In order to slidably couple the locking element 266 within the recess 268 of the second adjacent member 258, a plurality of first recesses or grooves 284 are provided within the recess 268. In this way, the engagement between the teeth first set of teeth 281 and the plurality of first recesses or grooves 284 of the second adjacent member 258 allows the locking element 266 to slide in an outward direction along the axis 260 as a result of the outward bias due to the spring element 270, or in an inward direction against the bias of the spring element 270 by depression of the depressible button 274.

In order to secure the first and second adjacent members 256, 258 together in a desired pivoted position, the first adjacent member 256 is provided with a second set of recesses or grooves 286. The second set of recesses or grooves 286 are disposed about the second opening 276 of the first adjacent member 256. In this way, as the spring element 270 biases the locking element 266 outward within the recess 268 of the second adjacent member 258, the second set of protrusions or teeth 282 are received within the second set of recesses or grooves 286 of the first adjacent member 256. This engagement locks the first and second adjacent members 256, 258 in a given position. When the user depresses the depressible button 274 of the locking element 266, the locking element 266 slides along the axis 260 as the first set of protrusions or teeth 281 slide along the plurality of first recesses or grooves 284 to disengage the second set of protrusions or teeth 282 from the second set of recesses or grooves 286, allowing the first and second adjacent members 256, 258 to again pivot relative to one another.

It will be appreciated by those of skill in the art that recesses or grooves are formed between protrusions or teeth. Accordingly, the language utilized in describing the structures relative to the locking element 266 and the first and second adjacent members 256, 258 is intended to likewise include a locking element 266 including a plurality of recesses or grooves, and the first and second adjacent members 256, 258 including a plurality of protrusions or teeth.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A flexible skeletal element configured to be coupled with a handle assembly and a dusting element for dusting around objects, the flexible skeletal element comprising:

a base;

at least three elongated arms, each of the at least three elongated arms having a base end and a distal end, the base ends extending from the base and being spaced apart from one another at the base, the elongated arms being flexible and resilient;

a plurality of cross-members extending between the elongated arms; and a plurality of living hinges disposed between the plurality of cross-members and the elongated arms;

wherein a force applied to at least one of the elongated arms is transmitted to at least one of the other of the elongated arms by the plurality of cross-members and the plurality of living hinges.

2. The flexible skeletal element of claim 1 wherein each of said elongated arms has a length, and wherein the force applied to the at least one of the elongated arms causes at least three of the living hinges disposed between a first of said plurality of cross-members and said elongated arms to flex, and a distance between at least a portion of the length of a first of said elongated arms and a portion of the length of a second of said elongated arms to be reduced.

3. The flexible skeletal element of claim 1 wherein the elongated arms converge toward one another from the base ends to the distal ends.

4. The flexible skeletal element of claim 1 wherein the distal ends of the elongated arms are coupled together.

5. The flexible skeletal element of claim 4 further comprising a distal element, the distal ends of the elongated arms being connected to and coupled together by the distal element.

6. The flexible skeletal element of claim 5 wherein the elongated arms extend substantially parallel to one another from the base before converging toward one another and being coupled together by the distal element.

7. The flexible skeletal element of claim 5 wherein the distal element has a cone shape and includes a plurality of ribs.

8. The flexible skeletal element of claim 1 wherein the plurality of cross-members includes a plurality of cross-member arms.

9. The flexible skeletal element of claim 8 wherein the plurality of cross-member arms include thinned distal ends, and the plurality of living hinges includes said thinned distal ends.

10. The flexible skeletal element of claim 1 wherein the elongated arms have a cross-section, the cross-section including a projection, the projection being disposed toward adjacent living hinges.

11. The flexible skeletal element of claim 1 wherein the flexible skeletal element is omnidirectionally flexible when at least one outside force is applied to at least one of the at least three elongated arms.

12. The flexible skeletal element of claim 1 wherein the at least three elongated arms include four elongated arms.

13. A dusting tool including the flexible skeletal element of claim 1 and a handle assembly, the flexible skeletal element being coupled to the handle assembly.

14. The dusting tool of claim 13 wherein at least one of the base and the handle assembly further includes at least one outwardly extending projection wherein the projection is adapted to engage the dusting element.

15. The dusting tool of claim 13 wherein the handle assembly includes a grip element.

16. The dusting tool of claim 13 wherein the flexible skeletal element is rotatably coupled to the handle assembly.

17. The dusting tool of claim 13 wherein one of the handle assembly and the base includes a protrusion and the other of the handle assembly and the base includes a recess, the protrusion being received within the recess.

18. The dusting tool of claim 13 wherein the handle assembly includes an elongated rod.

19. The dusting tool of claim 18 wherein the elongated rod includes at least one of a telescoping section whereby the dusting tool may be lengthened or shortened, and a separable connection whereby the dusting tool may disassembled into at least two subassemblies.

20. The dusting tool of claim 13 wherein the handle assembly further includes a selectively pivotable joint.

21. The dusting tool of claim 20 wherein the selectively pivotable joint includes an actuator coupled to at least one of a first adjacent member and a second adjacent member, and at least one locking element coupled to at least one of the first adjacent member and the second adjacent member, the actuator being selectively movable to cause engagement of the at least one locking element to retain first adjacent member and the second adjacent member in preset relative positions.

22. The dusting tool of claim 13 further comprising a dusting element disposed over and coupled to the flexible skeletal element.

23. A flexible skeletal element configured to be coupled with a handle assembly and a dusting element for dusting around objects, the flexible skeletal element comprising:

a base;

at least three elongated arms wherein each of the at least three elongated arms has a length, a base end and a distal end, the base ends extending from the base and being spaced apart from one another at the base, the elongated arms being flexible and resilient;

a plurality of cross-members extending between the elongated arms; and a plurality of living hinges disposed between the plurality of cross-members and the elongated arms;

wherein a force applied to at least one of the elongated arms causes at least three of the plurality of living hinges disposed between a first of said plurality of cross-members and said elongated arms to bend, and a distance between at least a portion of the length of a first of said elongated arms and a portion of the length of a second of said elongated arms to be reduced.

24. A dusting tool configured to be coupled with a dusting element for dusting around objects, the dusting tool comprising:

a flexible skeletal element including a base;

four elongated arms, each of the elongated arms having a base end and a distal end, the base ends extending from the base and being spaced apart from one another at the base, the elongated arms being flexible and resilient;

a distal element, the distal ends of the elongated arms being coupled together at the distal element, the elongated arms converge toward one another from the base ends to the distal ends;

a plurality of cross-members disposed between the elongated arms, each of the plurality of cross-members includes a plurality of cross-member arms; and a plurality of living hinges extending between the plurality of cross-members and the elongated arms;

wherein the flexible skeletal element is unitarily molded; and wherein the flexible skeletal element is omnidirectionally flexible when at least one outside force is applied to at least one of the four elongated arms;

a handle assembly, the base being coupled to the handle assembly.

* * * * *